United States Patent [19]

Upchurch

[11] 4,314,678

[45] Feb. 9, 1982

[54] APPARATUS FOR ROTATABLY SUPPORTING DEFORMABLE TUBULAR ROLLER BASE MEANS

[76] Inventor: Lewis E. Upchurch, 204 S. Venus Ave., Clearwater, Fla. 33515

[21] Appl. No.: 147,935

[22] Filed: Jun. 12, 1980

[51] Int. Cl.[3] ..... B65H 19/00

[52] U.S. Cl. ..... 242/55.2; 242/68

[58] Field of Search ..... 242/55.2, 55.3, 55.42, 242/129, 129.5

[56] References Cited

U.S. PATENT DOCUMENTS

| | | | |
|---|---|---|---|
| 2,571,321 | 10/1951 | Wettley | 242/55.2 |
| 3,770,221 | 11/1973 | Stern | 242/55.2 |
| 3,788,573 | 1/1974 | Thomson et al. | 242/55.2 |

*Primary Examiner*—Leonard D. Christian
*Attorney, Agent, or Firm*—Ronald E. Smith

[57] ABSTRACT

An apparatus for rotatably mounting a hollow deformable base means carrying a predetermined amount of a substantially flexible material in rolled relation thereon. A plurality of radially disposed elongate fin members are mounted in circumferentially spaced relation about an elongate spindle means that has a novel internal spring return mechanism biased against removal of said flexible material from said roller base means when said fin-carrying spindle means is snugly and slideably received within the hollow interior of said deformable base means in supporting conjointly rotatable relation therewith.

9 Claims, 4 Drawing Figures

APPARATUS FOR ROTATABLY SUPPORTING DEFORMABLE TUBULAR ROLLER BASE MEANS

BACKGROUND OF THE INVENTION

1. Field of the Invention

This invention relates generally to roller mechanisms, more particularly to roller mechanisms having internal spring return mechanisms, and specifically to such a roller mechanism carrying a plurality of radially disposed fins so that said flexible roller base means of differing sizes can be rotatably supported by such roller mechanism attendant at least some deformation of such flexible roller base means.

2. Description of the Prior Art

There are many roller mechanisms capable of adequately supporting roller base means carrying sheet material in rolled configuration thereabout. Perhaps the most ubiquitous of such roller mechanisms is the common bathroom tissue roller mechanism.

Conventional bathroom tissue is normally stored in rolled configuration about a deformable base means that in turn is rotatably mounted on a non-rotatable spring-loaded telescoping rod that engages a support surface at its opposing ends. Accordingly, removal of tissue paper effects rotation of the base means, but not of the telescoping rod. This arrangement encourages excess use of toilet paper, in that the tissue consumer encounters no increased resistance attendant unrolling of the tissue from the roller base means. Further, unsightly amounts of tissue paper are often left dangling due to the absence of any spring return mechanisms in the conventional roller apparatus.

Since use of the passive telescoping rod of the prior art is so widespread, a spring return mechanism is needed that is readily adaptable to existing support structures, whether of the recessed or projecting type. Even more importantly, a mechanism is needed that can accept roller base means of differing sizes. A device having all of these desired features does not appear in the prior art.

SUMMARY OF THE INVENTION

The longstanding but heretofore unfulfilled need for a device overcoming the deficiencies of the prior art is fulfilled by the present invention that comprises an elongate tubular spindle means that carries a plurality of circumferentially spaced elongate fins thereon in co-linear alinement therewith. One end of each fin is tapered so that deformable roller base means of differing diameters can be snuggly fitted about the outermost edges of the fins. Smaller roller base means will therefore deform to a greater extent than larger in diameter roller base means.

An important structural feature of the invention lies in the provision of a longitudinally disposed bias means, preferably a spring, that has one of its ends anchored against rotation by reason of attachment to a non-rotatable Reel-defining flange, also referred to hereinafter as the stabilizing flange, and that has its other end anchored to a spindle engaging rim means that rotates conjointly with the fin-carrying spindle whenever tissue paper is removed from the flexible roller base means.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
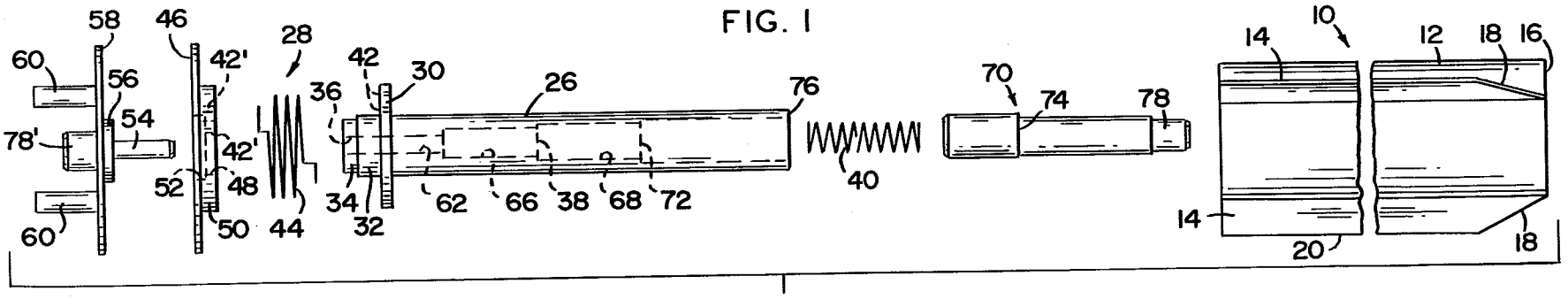
FIG. 1 is an exploded perspective view of the preferred embodiment of the invention, showing the axial alignment of its constituent parts.

Referring now to FIG. 1, it will be seen that the roller-supporting main spindle element, designated 10 as a whole, has an elongate hollow tubular portion 12. A plurality of at least two radially disposed elongate fin members collectively designated 14, extend at least a major portion of the hollow tubular portion 12. The preferred embodiment contemplates the provision of three fins of substantially equal dimensions circumferentially spaced about the hollow tubular portion 12, disposed in equi-distant angular orientation relative to one another, i.e., the fins are spaced approximately at 120° intervals.

The fins 14 adjacent the roller receiving end, designated 16, are tapered as at 18 so that roller means (not shown) of differing sizes may be slidingly and snugly engaged by the spindle 10. The snug fit between the outer peripheral edges 20 of the fin members 14 and the inner cylindrical surface of a roller means is sufficiently snug so that the spindle 10 and the roller means (not shown) will rotate conjointly.

An inwardly projecting annular wall 22 is formed (FIG. 2) on the interior surface of the hollow tubular portion 12 of the spindle 10, and has a centrally disposed aperture 24 for receiving therethrough an elongate tubular member 26 that comprises a part of a spring-return mechanism, generally designated 28.

The elongate tubular portion 26 includes a disc-shaped stabilizing flange 30 adjacent one end of the elongate tubular member 26, and further includes a spacing disc 32 and an extension disc 34, each disc 32,34 having an axial bore 36.

The inner bore of the elongate tubular member 26 is stepped as at 38 to provide a shoulder for supporting a first bias means 40 disposed interiorly of the elongate tubular member 26.

In assembling the invention, the end of the elongate tubular member 26 opposite the stabilizing flange 30 is introduced into the open end of the roller supporting main spindle element 10 opposite from the roller receiving end. The elongate tubular portion 26 of the spring return mechanism 28 is slidingly inserted through the central opening 24 of the inwardly directed annular wall 22, it now being understood that the outer diameter of the tubular portion 26 is slightly less than the inner diameter of the central opening 24 of the annular wall 22. Insertion of the elongate tubular member 26 into the hollow interior of the spindle 10 is continued until the stabilizing flange 30 enters at least partially thereinto, it now being clear that the outer diameter of the stabilizing flange 30 is slightly less than the inner diameter of the spindle 10. Since the opening 24 in the annular wall 22 that supports the elongate tubular member 26 is longitudinally spaced from the stabilizing flange 30, it is clear that the wall 22 and the flange 30 co-act to concentrically mount the elongate tubular member 26 within the spindle 10.

The stabilizing flange 30 forms a part of the spring return mechanism 28 and has a small aperture 42 for receiving therethrough one end of a second bias means 44, thereby anchoring the same. The opposite end of the spring 44 is held in a similar aperture 42' formed in another element of the invention, the spindle-engaging rim means 50. The extension disc 34, above-mentioned, extends through an aperture 48 formed centrally of the rim means 50. An end plate means 46 is integrally formed with the spindle-engaging rim 50, and serves to facilitate insertion of the rim 50 into the spindle 10. Thus, relative rotation between the flange 30 and the spindle-engaging rim 50 loads spring 44.

It should be noted that the rim 50 and the flange 30 collectively define a reel means for the second bias means, i.e., one end of the spring 44 abuts a face of the rim 50 and the other end of the spring 44 abuts a face of the flange 30. The initial step, therefore, in the assembly of the invention, contemplates proper disposition of the spring 44 between the rim 50 and flange 30 by anchoring the spring's opposite ends in the corresponding apertures 42, 42'. The elongate tubular member 26 is then slidingly engaged through the central opening 24 of the inwardly directed wall 22 as aforesaid, until the stabilizing flange 30 enters the hollow interior of the spindle 10, as aforesaid. The spindle engaging rim 50 is then snugly inserted into the open end of the spindle 10 opposite its roller-receiving end, so that the end plate 46 will correctly cap said open end. Extension disc 34 will now extend at least partially through the opening 48 in the rim means 50. Spacing disc 32 will not extend through said central opening 48 due to its diameter being slightly greater than the diameter of the opening 48. The spacing disc 32 therefore holds the rim portion 50 of the end plate 46 in fixed spaced relation to the stabilizing flange 30, defining therebetween the reel for the containment of the second bias means, as aforesaid. The snug fit between the rim 50 and the inner cylindrical walls of the spindle 10 ensures conjoint rotation of said rim-carrying end plate 46 and the spindle 10. Since the rotatable rim 50 carries one end of spring 44, it will now be appreciated that the stabilizing flange 30 formed integrally with the elongate tubular member 26 is non-rotatable. The extension disc 34 snugly receives within its interior bore 36, above mentioned, a non-rotating axle means 54 that in turn is integrally formed with and orthogonally protrudes from a projecting disc 56 that is formed integrally with a support surface engaging disc 58. The support surface engaging disc has a pair of circumferentially spaced engaging lugs 60 projecting orthogonally from the face opposite the face carrying the projecting disc 56 and the non-rotatable axle 54.

Figure 3:
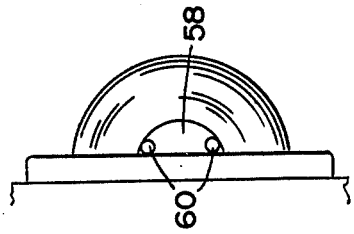
FIG. 3 is a perspective view of the invention installed in a conventional bathroom fixture of the recessed type.
Figure 4:
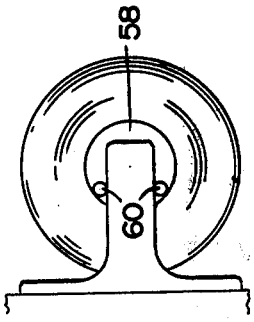
FIG. 4 is a perspective view of the invention installed in a conventional bathroom fixture of the projecting type.

Accordingly, the assembly of the invention contemplates insertion of the axle 54 into the interior bore 36 of the extension disc (which bore continues through the spacing disc 32 and into the elongate tubular member 26). When the axle 54 is fully inserted, projecting disc 56 will hold rotatable end plate 46 and non-rotatable support surface engaging disc 58 in fixed spaced apart relation. The lugs 60 will engage a support surface, as shown in FIGS. 3 and 4 and thus hold the disc 56 and consequently the axle 54 and the stabilizing flange 30 (carrying one end of spring 44) against rotation thereof.

An annular recess is formed in the face of the end plate 46 that is presented to the mounting disc 58 for reception therein of at least a part of the projecting disc 56. Since the axle 54 projects outwardly from the top surface of the projecting disc 56, it is clear that the annular recess 52 allows for optimal insertion of the axle 54 into the bore of the extension disc, the spacing disc and the elongate tubular member. The amount of spacing between the end plate 46 and the mounting disc 58 is thus seen to be defined by the excess in axial thickness of the projecting disc 56 relative to the axial depth of the recess portion 52.

Having thus capped the spindle 10 with end plate 46 and having attached the mounting disc 58 as aforesaid, the remaining steps in the assembly of the invention contemplate the placing of the first bias means 40 interiorly of the elongate tubular member 26 by inserting such bias means 40 into its open end, said open end opposite its stabilizing flange 30, spacing disc 32 and extension disc-Carrying end. The bias means 40, when so inserted, will rest interiorly of the elongate tubular member 26 on an inwardly directed annular support shelf 38. It should be noted that the axle 54 receiving bore that extends through the extension disc 34, spacing disc 32 and a portion of the elongate tubular member 26 preferably terminates as at 64. The enlarged bore portion 66 is provided to conserve construction materials. Beyond the shelf 38, i.e., from the shelf 38 to the open end of the elongate tubular member, the interior bore of the elongate tubular member is of sufficient diameter to receive therein the first spring 40. The shoulder portion 38 defined at the juncture of the material-conserving bore 66 and the large diameter spring receiving bore 68 supports one end of the spring 40. The final element of the invention, the telescoping member 70, is slidingly received within the elongate tubular member 26 and acts to bear against the end of the spring opposite the shoulder 38 supported end. In this manner, the invention is adaptable to engage roller support structures of differing dimensions.

The spring receiving bore 68 is stepped as at 72 to limit the longitudinal travel of the telescoping element 70 so that the elastic limit of the spring 40 is not exceeded. Further, to bar against inadvertant removal of the telescoping member 70 from the interior bore of the elongate tubular member, an annular ridge means is formed about the periphery of the telescoping member as at 74 for engaging the rim 76 of the open end of the elongate tubular member 26. The ridge means 74, as well as the telescoping member 70 and the elongate tubular member 26 are all formed of a slightly deformable, resilient material. Thus, insertion and withdrawal of the telescoping means 70 into and from, respectively, the elongate tubular member 26 can be accomplished by the external application of force, but the ridge 74 will prevent the spring 40 from causing the expulsion of the telescoping member 70 from the interior bore 68 of the elongate tubular member.

The telescoping member 70 terminates in a stepped down portion 78 that engages an existing roller support means. Its counterpart, designated 78' is formed centrally of the mounting disc 58 and projects therefrom co-linearly with the circumferentially spaced lugs 60.

Figure 2:
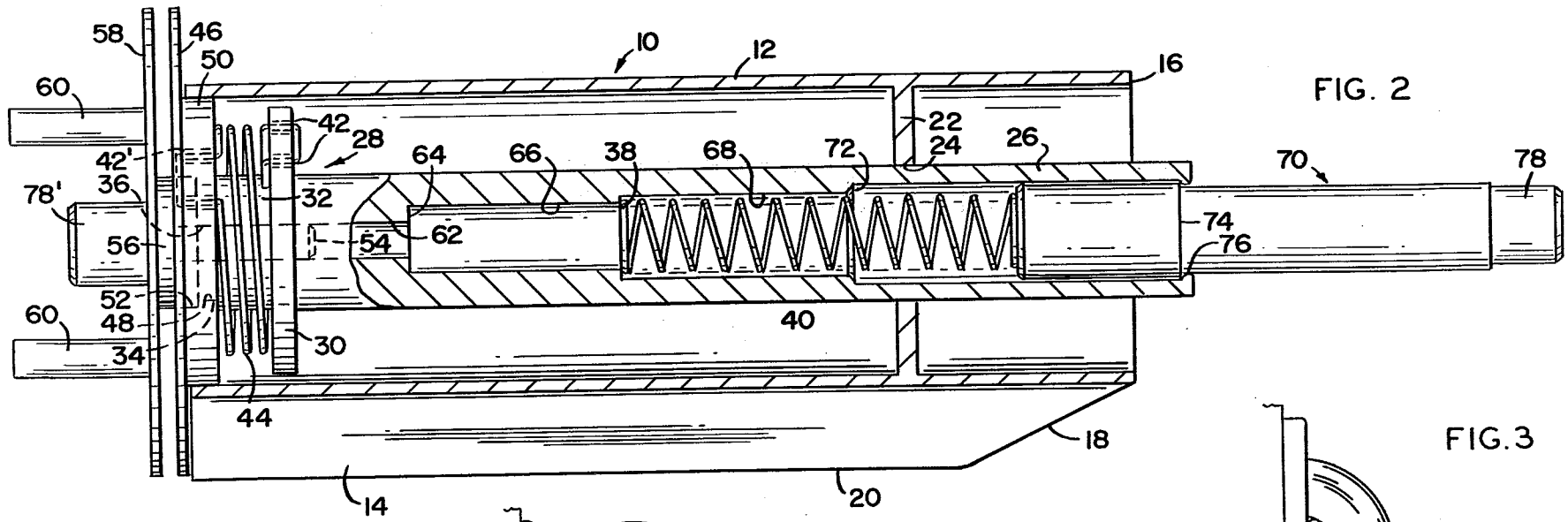
FIG. 2 is a partially cut-away longitudinal cross sectional view taken along line 2—2 in FIG. 1, showing the preferred embodiment in its assembled configuration.

FIG. 2 is a partially cut-away elevational view of the invention when fully assembled. FIGS. 3 and 4 show the invention in place in conventional rollersupporting structures of the recessed type and of the projecting type, respectively.

When a tissue-carrying roller of any commercially-available size is slidingly inserted onto the inventive spindle 10, the outer edges of the fins 14 will snugly engage the inner cylindrical surface of such roller means (not shown). Since virtually all commercially-available tissue-carrying roller means are made of deformable substances, the roller means will deform and adopt a shape as defined by the plurality of fins 14. The smaller the diameter of the roller means, the greater will be the amount of deformation.

Removing a length of tissue paper will effect rotation of the deformed tissue carrying roller means and due to the snug fit between the outer edges of the fins and the inner surface of the roller means, a simultaneous and corresponding rotation of the spindle 10 will thereby occur, which in turn effects a simultaneous and corresponding rotation of the end plate 46 and of one end of spring 44, i.e., the end anchored in rim means 50. Since the other end of spring 44 is anchored in the stabilizing flange 30 forming a part of the elongate tubular member 26, which in turn is barred against rotation by reason of its engagement to non-rotating mounting disc 58 through axle 54, such tissue removal will load spring 44. The tissue consumer will be increasingly restrained from taking excess amounts of tissue from the spindle 10 by reason of the increased loading of spring 44 with every increment of angular rotation imparted to the spindle. When adjacent sections of tissue paper are separated in the conventional manner along the standard perforation lines, the spring 44 and hence the spindle 10 will return to their equilibrium position, thereby neatly re-rolling any quantities of tissue paper left in at least partially unrolled configuration.

It will thus be seen that the objects set forth above, and those made apparent from the preceding description, are efficiently attained and since certain changes may be made in the above construction without departing from the scope of the invention, it is intended that all matters contained in the above description or shown in the accompanying drawings shall be interpreted as illustrative and not in a limiting sense.

It is also to be understood that the following claims are intended to cover all of the generic and specific features of the invention herein described, and all statements of the scope of the invention which as a matter of language, might be said to fall therebetween.

Now that the invention has been described,

What is claimed is:

1. An assembly for rotatably supporting deformable tubular roller means of differing diameters, comprising, a spindle means of generally tubular configuration and having a diameter less than the diameter of said tubular roller means, a plurality of at least two circumferentially spaced fin members projecting radially from said spindle means, said fin means extending at least a major portion of the length of said spindle means, each of said fin means tapered downwardly at one end thereof so that said tubular roller means can be easily slidingly inserted on said spindle means attendant deformation of said roller means if the inner diameter of said roller means is less than the diameter of an imaginery circle defined collectively by the outer edges of said circumferentially spaced fin means, an internal spring return mechanism for urging said fin-carrying spindle and hence said roller means into an equilibrium position when an external force is applied to said roller means to impart rotation thereto, said mechanism comprising an end plate means synchronously rotatable with said spindle means, said mechanism further comprising a longitudinally disposed first bias means having opposed first and second ends, said first end of said first bias means anchored to said end plate means, said second end of said first bias means anchored to a non-rotating means so that rotation of said deformable roller means and hence of said spindle means and hence of said end plate means operates to load said first bias means to the end that said first bias means returns said spindle to its equilibrium position when said external force effecting rotation of said spindle is removed.

2. The assembly of claim 1, wherein said non-rotating means securing said second end of said first bias means against rotation comprises an elongate tubular member disposed interiorly of said spindle means in axial alignment therewith, and a non-rotating support surface-engaging member in rigid communication with said elongate tubular member disposed interiorly of said spindle means.

3. The assembly of claim 2, further comprising means for adapting said roller-carrying spindle means to transiently engage existing roller support structures, said adaptation means comprising a second longitudinally disposed bias means disposed interiorly of said elongate tubular member that in turn is disposed interiorly of and concentrically with said spindle means, means for barring longitudinal displacement of said elongate tubular member, and tubular telescoping means slidingly received within said elongate tubular member, said telescoping means having one end thereof abutting said second bias means and having its opposite end adapted for rotational engagement with said existing roller means support structure.

4. The assembly of claim 3, said means for barring said elongate tubular member against longitudinal movement comprising a portion of said non-rotating support surface-engaging member, said portion comprising an axle-type means projecting longitudinally from said support surface-engaging member and slidingly and snugly fit within a complementally formed bore means comprising a part of said elongate tubular member so that when said assembly is installed, said support surface-engaging member bars said elongate tubular member against longitudinal movement and against rotational movement.

5. The assembly of claim 4, further comprising means for holding said support surface engaging member and said end plate in fixed spaced relation so that said end plate can rotate freely relative to said engaging member, said means comprising a projecting disc means formed integrally with said engaging means, said axle-type means projecting from said projecting disc, said end plate having a recess portion of diameter greater than the diameter of said projecting disc for at least partially receiving therein said projecting disc.

6. The assembly of claim 5, wherein said support surface engaging member comprises a generally disc-shaped member having opposing faces, one of said faces having an existing roller support structure-engaging pin means, disposed centrally thereof and projecting therefrom, said face further having at least two support surface-engaging lugs projecting co-linearly with said pin means, said lugs circumferentially spaced on the perimeter of said disc-shaped support surface-engaging member, said opposite face of said member having formed thereon said projecting disc and said axle-like means non-rotatably received within the bore of said elongate tubular member so that the fixed position of said support surface engaging member is rigidly communicated to said elongate tubular member through said axle-like means.

7. The assembly of claim 6, wherein said elongate tubular member has an orthogonally disposed stabilizing flange formed adjacent one end thereof and adapted for non-contacting slide-fit engagement with the inner cylindrical walls of said fin-carrying spindle means, and wherein said spindle means has an inwardly directed annular wall provided with a central aperture for receiving therethrough the end of said elongate tubular member opposite said flange carrying end so that the longitudinal spacing of said stabilizing flange and said aperture-defining wall disposes said elongate tubular member in concentric alignment with said fin-carrying spindle means.

8. The assembly of claim 7, wherein said end plate has a rim portion integrally formed therewith, said rim portion configured and dimensioned to snugly and slidingly fit at least partially within the hollow interior of said spindle means to effect conjoint rotation of said spindle means and said end plate, said rim portion and said stabilizing flange member collectively defining therebetween a reel means for retaining said first bias means forming a part of said spring return means, said rim portion and said flange portion having opposite ends of said first bias means fixedly secured thereto to that relative rotation therebetween loads said first bias means.

9. The assembly of claim 1, wherein said plurality of fin members comprises three equi-spaced fins angularly disposed about the periphery of said spindle means.

* * * * *